US009681213B2

(12) United States Patent
Siotis

(10) Patent No.: US 9,681,213 B2
(45) Date of Patent: Jun. 13, 2017

(54) HEADPHONE DEVICE, AUDIO DEVICE, AND METHOD FOR OPERATING A HEADPHONE DEVICE

(71) Applicant: Sony Mobile Communications Inc., Tokyo (JP)

(72) Inventor: Georg Siotis, Lund (SE)

(73) Assignees: SONY CORPORATION, Tokyo (JP); SONY MOBILE COMMUNICATIONS INC., Tokyo (JP)

( * ) Notice: Subject to any disclaimer, the term of this patent is extended or adjusted under 35 U.S.C. 154(b) by 0 days.

(21) Appl. No.: 14/703,331

(22) Filed: May 4, 2015

(65) Prior Publication Data

US 2016/0330540 A1 Nov. 10, 2016

(51) Int. Cl.

| | |
|---|---|
| ***H04R 1/10*** | (2006.01) |
| ***G10K 11/175*** | (2006.01) |
| *H04R 5/033* | (2006.01) |

(52) U.S. Cl.

CPC ..... *H04R 1/1083* (2013.01); *G10K 11/175* (2013.01); *H04R 1/1025* (2013.01);

(Continued)

(58) Field of Classification Search

CPC ..... H04R 1/10; H04R 1/1025; H04R 5/033; H04R 25/00; H04R 25/43; H04R 25/50; H04R 25/502; H04R 25/505; H04R 25/507; H04R 25/602; H04R 25/60; H04R 25/65; H04R 25/652; H04R 25/654; H04R 25/656; H04R 25/658; H04R 3/12; H04R 3/00;

(Continued)

(56) References Cited

U.S. PATENT DOCUMENTS

2011/0033073 A1* 2/2011 Inoshita ..... H04R 25/552 381/323
2013/0051561 A1* 2/2013 Ozawa ..... H04R 1/1083 381/17

(Continued)

FOREIGN PATENT DOCUMENTS

EP 2293599 A1 3/2011

OTHER PUBLICATIONS

International Search Report and Written Opinion from counterpart International Patent Application No. PCT/EP2016/057107, mailed Jun. 22, 2016.

(Continued)

*Primary Examiner* — Leshui Zhang
(74) *Attorney, Agent, or Firm* — Tucker Ellis LLP

(57) ABSTRACT

A headphone device includes an electric input terminal for receiving an electric audio signal, an electric energy storage device, and a charging device coupled to the electric input terminal and the electric energy storage device. The charging device is configured to charge the electric energy storage device with electric energy from the electric audio signal. An audio device includes an electric output terminal for outputting an electric audio signal from an audio source of the audio device, and an audio energy supply device configured to generate an additional electric audio signal with a frequency above a first frequency value and/or a frequency below a second frequency value, and to output the additional electric audio signal via the electric output terminal.

12 Claims, 2 Drawing Sheets

(52) U.S. Cl.
CPC ..... *G10K 2210/1081* (2013.01); *H04R 5/033* (2013.01); *H04R 2430/01* (2013.01); *H04R 2460/01* (2013.01); *H04R 2460/03* (2013.01)

(58) Field of Classification Search
CPC .... H04R 27/00; H04R 2227/003; H04R 5/02; H04R 2420/07; H04R 29/00; H04R 1/02; H04R 1/345; H04R 1/403; H04R 2201/028; H04R 29/007; H04R 3/007; H04R 3/04; H04R 2420/05; H04R 29/001; H04R 5/00; H04S 1/005; H04B 3/00; H04B 3/54; H04B 2203/5408; H04B 2203/5445; H04B 2203/5454; H04B 2203/545; H04B 1/385; H04N 21/234327; H04N 21/2662; H04N 21/439; H04W 4/01; H04M 1/00; H04M 1/05; H04M 1/6058; H04M 1/6066
USPC ..... 381/1, 26, 28, 309, 61, 317, 313, 321, 381/322, 312, 324, 326, 329, 330, 331, 381/71.7, 71.11, 71.12, 72, 74, 79, 83, 381/84, 334, 91, 92, 93, 94.1, 95, 100, 381/102, 104, 106, 111, 120, 122, 355, 381/356, 361, 367, 369, 370, 371, 374, 381/375, 376, 385, 387, 124, 55, 77, 381/71.6, 314, 323, 98, 99, 101, 103; 181/30, 139; 455/552.1, 553.1, 556.1, 455/575.2; 700/94
See application file for complete search history.

(56) References Cited

U.S. PATENT DOCUMENTS

| | | | | |
|---|---|---|---|---|
| 2013/0083927 | A1* | 4/2013 | Savant ..... | H04R 1/1025 381/2 |
| 2014/0247952 | A1* | 9/2014 | Goldstein ..... | H04R 1/1016 381/74 |
| 2014/0270229 | A1* | 9/2014 | Braho ..... | H04R 1/1025 381/74 |

OTHER PUBLICATIONS

Kuo, Ye-Sheng et al., "Hijacking Power and Bandwidth from the Mobile Phone's Audio Interface", Dec. 17, 2010, pp. 1-10.

* cited by examiner

HEADPHONE DEVICE, AUDIO DEVICE, AND METHOD FOR OPERATING A HEADPHONE DEVICE

BACKGROUND

The present invention relates to a headphone device, especially to a headphone device comprising an audio processing for an ambient noise cancelling. The present invention relates furthermore to an audio device which may be coupled to the headphone device, and to a method for operating the headphone device.

BRIEF SUMMARY OF THE INVENTION

According to an embodiment, a headphone device comprises an electric input terminal for receiving an electric audio signal, and electric energy storage device, and a charging device. The charging device is coupled to the electric input terminal and the electric energy storage device and is configured to charge the electric energy storage device with electric energy from the electric audio signal. The electric energy storage device may comprise for example a rechargeable battery, for example a Li-Ion-battery or a capacitor, for example a so-called super capacitor or ultra capacitor.

A headphone device, sometimes also called earphones, headphones or headsets, is commonly used for reproducing audio data to a user. The headphone device may be used for example in combination with an audio device providing audio data to be output to the user. The audio device may comprise for example a mobile music player, a mobile video player or a mobile telephone. The audio data may be output by the audio device as an electric audio signal. The audio data may comprise for example speech or music. However, listening to music or speech may be disturbed by ambient noise. Therefore, ambient noise cancelling (ANC) technologies may be implemented in the headphone device. Performing an ambient noise cancelling may consume a considerable amount of electric energy requiring for example a bulky battery in the headphone device. The headphone device according to embodiments of the present invention may avoid bulky batteries by providing the required electric energy by an electric energy storage device which is charged with electric energy from the electric audio signal. Thus, issues relating to the weight and accommodation space of bulky batteries may be avoided. Furthermore, the headphone device according to embodiments of the present invention may be connected to conventional devices like tablet PCs, mobile phones, music players and so on.

According to another embodiment, the headphone device comprises an audio processing device which is powered by electric energy from the electric energy storage device. The audio processing device may comprise for example a controller or a digital signal processor. The audio processing device is configured to receive the electric audio signal and to generate an electric audio output signal based on the received electric audio signal. The headphone device comprises furthermore an electroacoustic transducer which is coupled to the audio processing device and configured to output an acoustic signal based on the electric audio output signal generated by the audio processing device. For example, the headphone device may comprise furthermore a microphone providing an electric audio input signal based on an acoustic signal received by the microphone. The audio processing device may be coupled to the microphone and may generate the electric audio output signal based on the electric audio input signal from the microphone such that ambient noise is at least partially compensated by the acoustic signal at an output of the electroacoustic transducer. In other words, the audio processing device may receive an ambient noise via the microphone and may perform an ambient noise cancelling at the acoustic output of the headphone device.

In some other embodiments, the audio processing device is configured to control a volume of the electric audio output signal depending on a charging level of the electric energy storage device. During charging the electric energy storage device, a portion of the energy of the received electric audio signal is used for charging the electric energy storage device. Thus, the energy available to be output by the electroacoustic transducer is reduced. When the electric energy storage device is completely charged, the portion of electric energy available to be output by the electroacoustic transducer is increased. To avoid a change in volume of the acoustic signal output by the electroacoustic transducer, the audio processing device may control the volume at a constant level. Furthermore, the audio processing device may be configured to reduce the gain or volume of the headphone output such that the user increases the volume output of the audio device. As a result, the energy output from the audio device to the headphone device is increased and therefore, a reliable and rapid charging of the electric energy storage device may be achieved.

According to another embodiment, the headphone device comprises a high pass filtering device or a low pass filtering device or both. The high pass filtering device is coupled between the electric input terminal and the charging device and has a first cut of frequency. The low pass filtering device is coupled between the electric input terminal and the charging device and has a second cut off frequency. The first cut off frequency may be in a range from 16 kHz to 22 kHz and the second cut off frequency may be in a range from 16 Hz to 40 Hz. Preferably, the first cut off frequency has a value of 20 kHz and the second cut off frequency has a value of 20 Hz. Audio signals having a frequency above the first cut off frequency are usually inaudible for human beings. Also, audio signals having a frequency lower than the second cut off frequency are essentially inaudible to human beings. Therefore, the energy of audio signals passed by the high pass filtering device and by the low pass filtering device to the charging device may be used for charging the electric energy storage device without affecting the audio reproduction of the headphone device experienced by a user. Furthermore, the audio device may provide high electric energy in the electric audio signal at frequencies above the first cut off frequency and below the second cut off frequency which may be used for powering the electric energy storage device and the audio processing device without affecting the audible audio output of the headphone device.

In another embodiment, the headphone device comprises an electric illumination device which is powered by electric energy from the electric energy storage device. The electric illumination device may comprise for example a light emitting diode (LED) indicating that the ambient noise cancelling of the headphone device is working or which may be used as a torch light or a reading lamp.

According to another embodiment, an audio device is provided which comprises an electric output terminal for outputting an electric audio signal from an audio source of the audio device, and an audio energy supply device. The audio energy supply device is configured to generate an additional electric audio signal having a frequency above a first frequency value or a frequency below a second frequency value, and to output the additional electric audio signal via the electric output terminal. The audio source of the audio device comprises for example a music player, for example an MP3 player, or a receiver of a mobile phone. The electric audio signal may comprise therefore for example music or speech. The first frequency value may be in range from 16 kHz to 22 kHz and the second frequency value may be in a range from 16 Hz to 40 Hz. Preferably, the first frequency value is 20 kHz and the second frequency value is 20 Hz. Thus, the audio energy supply device generates an additional electric audio signal having a frequency which is inaudible to a human being. However, the energy provided by the audio energy supply device may be used by a headphone device connected to the electric output terminal for charging an electric energy storage device of the headphone device and for supplying an audio processing device of the headphone device with electric energy.

According to another embodiment, a method for operating a headphone device is provided. According to the method, an electric audio signal is received at the headphone device and an electric energy storage device of the headphone device is charged with electric energy from the electric audio signal.

In some embodiments, an audio processing device is powered by electric energy from the electric energy storage device. The audio processing device generates an electric audio output signal based on the received electric audio signal, and the generated electric audio output signal is output with an electroacoustic transducer resulting in an acoustic signal based on the generated electric audio output signal.

In another embodiment, the electric audio output signal is additionally generated based on an electric audio input signal from a microphone such that ambient noise is at least partially compensated by the acoustic signal at an output of the electroacoustic transducer. In other words, according to the method, an electric audio signal to be output via a headphone device is used additionally for charging an electric energy storage device which powers the audio processing device to cancel ambient noise at the output of the headphone device. As the noise cancelling is powered with electric energy derived from the electric audio signal, no bulky battery and no power supply line is required for powering the headphone device.

According to another embodiment, the method comprises furthermore a controlling of a volume of the electric audio output signal depending on a charging level of the electric energy storage device. This may help to compensate variations in volume output of the headphone device due to a varying amount of energy derived from the received electric audio signal for charging the electric energy storage device.

In another embodiment, the electric energy storage device is charged only with components of the electric audio signal which have a frequency above a first frequency value and/or components of the electric audio signal which have a frequency below a second frequency value. The first frequency value may be in a range of 16 kHz to 22 kHz, preferably may have a value of 20 kHz, and the second frequency value may be in a range from 16 Hz to 40 Hz, and may have preferably a value of 20 Hz. Thus, the electric energy storage device is charged only with components of the electric audio signals which are essentially inaudible to human beings. Therefore, the acoustic output of the headphone device may not be influenced by redirecting some energy of the received electric audio signal to the electric energy storage device.

Furthermore, in some embodiments an electric illumination device of the headphone device is powered by electric energy from the electric energy storage device.

Although specific features described in the above summary, and the following detailed description are described in connection with specific embodiments, it is to be understood that the features of the embodiments described herein can be combined with each other unless specifically noted otherwise.

BRIEF DESCRIPTION OF THE DRAWINGS

The present invention will now be described in more detail with reference to the accompanying drawings.

DESCRIPTION OF THE PREFERRED EMBODIMENTS

In the following, exemplary embodiments of the present invention will be described in more detail. It is to be understood that the features of the various exemplary embodiments described herein may be combined with each other unless specifically noted otherwise. Any coupling between components or devices shown in the figures may be a direct or indirect coupling unless specifically noted otherwise.

Figure 1:
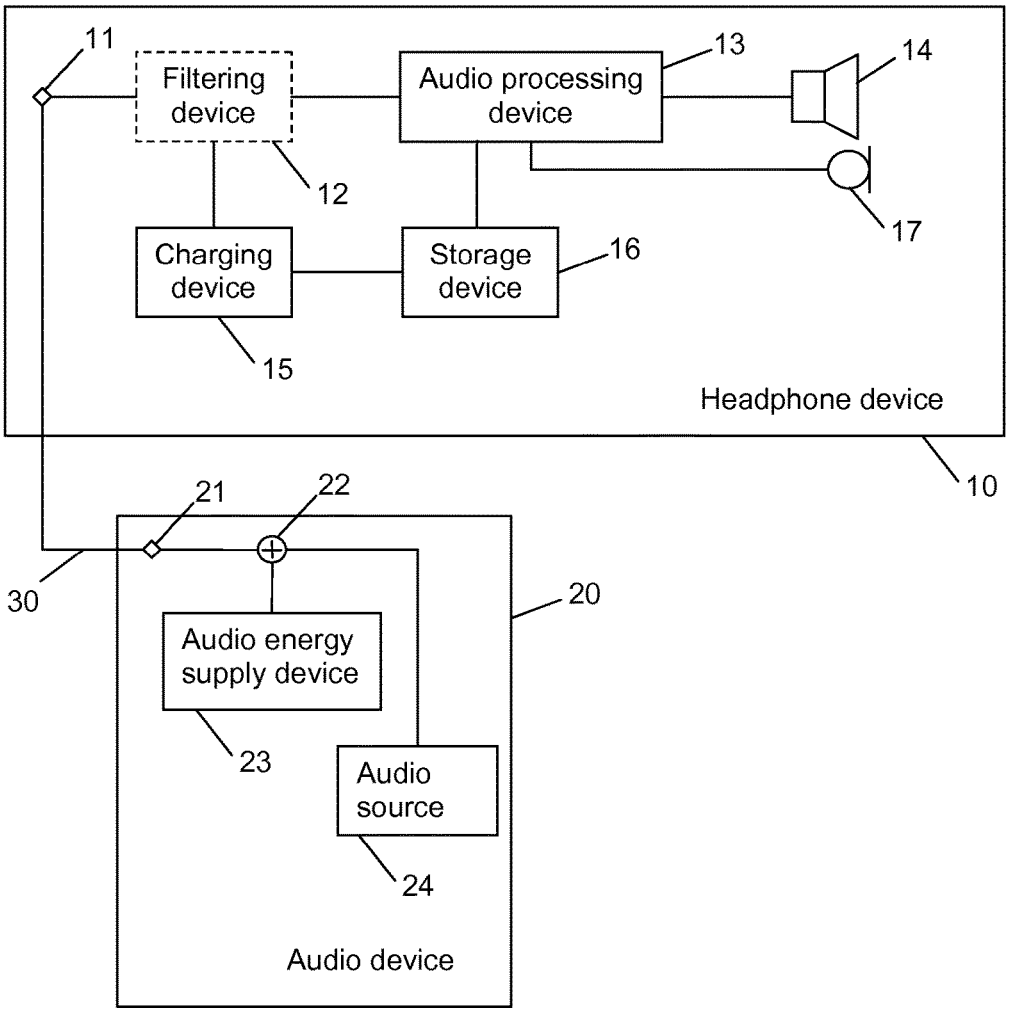
FIG. 1 shows schematically a headphone device and an audio device according to embodiments of the present invention.

FIG. 1 shows a headphone device 10 coupled via a wired connection 30 to an audio device 20. The headphone device 10 comprises an electric input terminal 11 for receiving an electric audio signal from the audio device 20, a filtering device 12, an audio processing device 13, an electroacoustic transducer 14, a charging device 15, an electric energy storage device 16, and a microphone 17. The audio device comprises an electric output terminal 21 for outputting an electric audio signal from an audio source 24 of the audio device 20 to the headphone device 10. The audio device 20 comprises furthermore an audio energy supply device 23 and a signal adding device 22.

In the headphone device 10, the microphone 17 is arranged adjacent to the electroacoustic transducer 14 for capturing ambient noise in an environment adjacent to the electroacoustic transducer 14. The electroacoustic transducer 14 may comprise for example a loudspeaker configured to be arranged near an ear of the user or in an ear of a user as a so called in-ear-loudspeaker. The headphone device 10 may comprise further components which are not shown in FIG. 1, for example a second loudspeaker outputting a second audio signal to a second ear of the user providing a stereo output. Furthermore, the headphone device may comprise another microphone for receiving audio signals near a mouth of the user for providing speech audio data from the headphone device to the audio device 20.

The audio device 20 comprises for example a mobile telephone, a tablet PC, a mobile music player or a media player. Therefore, the audio device may comprise further components, for example a display, a user interface and an energy source like a battery, which are not shown in FIG. 1.

Figure 2:
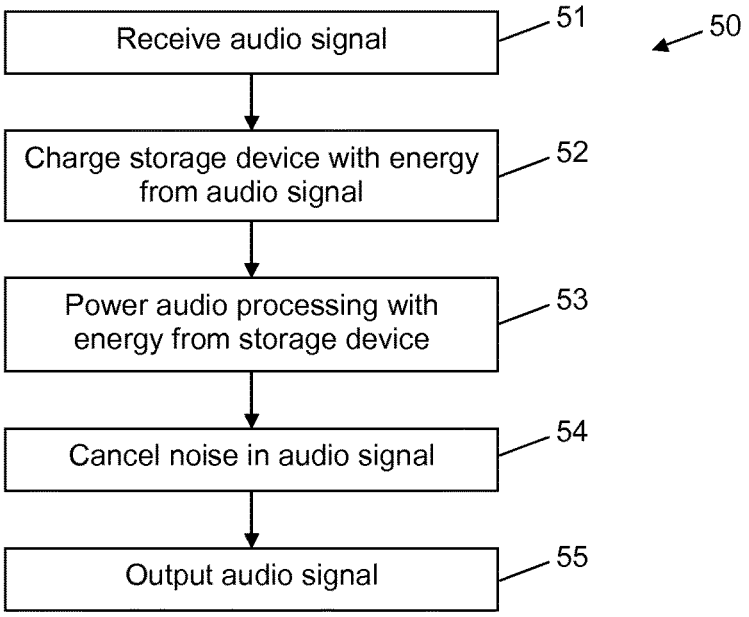
FIG. 2 shows a flow chart comprising the method steps for operating a headphone device according to an embodiment of the present invention.

Operation of the headphone device 10 will be described in the following in more detail with reference to a method 50 shown in FIG. 2. In step 51, the headphone device 10 receives via the electric input terminal 11 an audio signal from the audio device 20. The received electric audio signal is directed via the filtering device 12 to the audio processing device 13 and to the charging device 15. The filtering device 12 is optional as indicated by the dotted line in FIG. 1. As an alternative, the received electric audio signal may be simply split up and directed to the audio processing device 13 and the charging device 15. In step 52, the charging device 15 generates a charging current from the received electric audio signal and directs the charging current into the storage device 16. The storage device 16 may comprise for example a small rechargeable battery or a capacitor, for example a super capacitor. In step 53 the audio processing device 13 is powered with electric energy from the storage device 16. The audio processing device 13 is configured to perform an ambient noise cancelling algorithm. For performing the ambient noise cancelling (ANC) algorithm, the audio processing device comprises for example a digital signal processor or a controller.

In step 54, the audio processing device 13 receives ambient noise from the microphone 17 and modifies the electric audio signal received from the electric input terminal 11 such that the acoustic signal at an output of the electroacoustic transducer 14 compensates at least partially the ambient noise. The audio processing device 13 may perform for example a so-called feed forward ANC or a so called feed backward ANC or a hybrid ANC comprising a feed forward ANC as well as a feed backward ANC. The feed backward ANC uses a microphone receiving acoustic signals in an area between an output of the electroacoustic transducer 14 and an ear of the user, for example an in-ear-microphone, whereas the feed forward ANC comprises an external microphone arranged outside this area between the output of the electroacoustic transducer 14 and the ear of the user.

No matter which kind of ANC is used, the audio processing device 13 generates the ANC audio output signal and provides this audio output signal in step 55 to the electroacoustic transducer 14. The acoustic signal output by the electroacoustic transducer 14 comprises an ambient noise compensating portion such that ambient noise is cancelled by interference at the output of the electroacoustic transducer 14. Therefore, a user listening to audio data output by the audio device in a noisy environment may receive an enhanced acoustic signal comprising less noise from the environment. As the audio processing device 13 is powered with energy from the storage device 16 which is charged by energy from the received electric audio signal, the headphone device 10 requires no bulky battery for supplying energy to the audio processing device 13 and requires no addition power supply from the audio device 20.

A typical audio device 20, for example a mobile telephone or an MP3 player, is able to provide an electric audio signal having about 400 mV to 500 mV RMS over 32 Ohms continuously on each channel. This results in a total of about 10 mW charging power available for both channels. This amount of energy may be sufficient to power the audio processing device 13 for performing the ambient noise cancelling. However, at the beginning, the storage device 16 may be empty and has to be charged before the noise cancelling may be performed. During this time, from some seconds to a minute, the headphone device 10 may be operated in a "bypass" mode without ambient noise cancelling. When the storage device 16 reaches a certain charging level, the ambient noise cancelling will be started in the audio processing device 13. The user will notice it as the ambient noise suddenly is attenuated, for example by typically 20 to 26 dB. The size of the storage device 16 may be dimensioned such that quiet music passages in the audio signal will not cause the audio processing device to stop the ambient noise cancelling.

Additionally or as an alternative, the audio device 20 may provide additional electric energy via the electric audio signal in frequency ranges which are inaudible for a user. For example, the audio device 20 comprises the audio energy supply device 23 which generates an additional electric audio signal with a high amplitude at a frequency above a first frequency value, for example above 20 kHz, and at a frequency below a second frequency value, for example below 20 Hz. This additional electric audio signal is added to the electric audio signal from the audio source 24 by a signal adding device 22. The combined electric audio signal is output via the electric output terminal 21 to the headphone device 10.

The headphone device 10 receives the combined electric audio signal at input terminal 11 and the filtering device 12 directs frequency components between 20 Hz and 20 kHz to the audio processing device 13, whereas the remaining frequency components below 20 Hz and above 20 kHz are directed to the charging device 15. The filtering device 12 may comprise for example a high pass filter and low pass filter or a combination thereof or a crossover network. By redirecting the high and low frequencies to the charging device 15 and the storage device 16, the audio signal output to the electroacoustic transducer 14 is not disturbed.

The charging device 15 may comprise for example an ultra low power DC-DC boost charger with high efficiency. The voltage of the electric audio signal received by the charging device 15 may be in a range of 300 to 500 mV. The charging device 15 may comprise a DC-DC-converter for providing a charging voltage of about 1.0 V for the storage device 16. As described above, the headphone device 10 may comprise a second electroacoustic transducer for outputting a second electric audio signal thus providing a stereo output. The charging device 15 may receive and use electric energy from the second electric audio signal and may store this additional electric energy in the storage device 16. Likewise, the audio processing device 13 may also process the electric audio signal to be output to the second electroacoustic transducer. For example, a second microphone in close vicinity to the second electroacoustic transducer may be provided to receive ambient noise which may be received by the audio processing device 13 to perform an ambient noise cancelling during output of the second electric audio signal.

What is claimed is:

1. A headphone device, comprising:

an electric input terminal for receiving an electric audio signal;

an electric energy storage device;

a charging device coupled to the electric input terminal and the electric energy storage device and configured to charge the electric energy storage device with electric energy from the electric audio signal;

an audio processing device configured to receive the electric audio signal and to generate an electric audio output signal based on the received electric audio signal; and an electroacoustic transducer coupled to the audio processing device for outputting an acoustic signal based on the generated electric audio output signal; and wherein the audio processing device is powered by electric energy from the electric energy storage device; and wherein the audio processing device is configured to control a volume of the electric audio output signal at a constant level depending on a charging level of the electric energy storage device to compensate for variations in volume output of the headphone device due to a varying amount of energy derived from the received electric audio signal for charging the electric energy storage device.

2. The headphone device according to claim 1, comprising:

a microphone providing an electric audio input signal based on an acoustic signal received by the microphone; and wherein the audio processing device is coupled to the microphone and configured to generate the electric audio output signal based on the electric audio input signal from the microphone such that ambient noise is at least partially compensated by the acoustic signal at an output of the electroacoustic transducer.

3. The headphone device according to claim 1, comprising at least one of:

a high pass filtering device coupled between the electric input terminal and the charging device and having a first cutoff frequency; and a low pass filtering device coupled between the electric input terminal and the charging device and having a second cutoff frequency.

4. The headphone device according to claim 3, wherein the first cutoff frequency is in a range from 16 kHz to 22 kHz, and the second cutoff frequency is in a range from 16 Hz to 40 Hz.

5. The headphone device according to claim 4, wherein the first cutoff frequency is 20 kHz.

6. The headphone device according to claim 4, wherein the second cutoff frequency is 20 Hz.

7. The headphone device according to claim 1, comprising:

an electric illumination device powered by electric energy from the electric energy storage device.

8. The headphone device according to claim 1, wherein:

the electric audio signal is received via an electric output terminal of an audio device; and the electric audio signal comprises a first component from an audio source of the audio device and a second component from an audio energy supply device of the audio device, the second component having at least one of a frequency above a first frequency value or a frequency below a second frequency value.

9. A method for operating a headphone device, comprising:

receiving an electric audio signal at the headphone device;

charging an electric energy storage device of the headphone device with electric energy from the electric audio signal;

powering an audio processing device with electric energy from the electric energy storage device;

generating, with the audio processing device, an electric audio output signal based on the received electric audio signal;

outputting, with an electroacoustic transducer, an acoustic signal based on the generated electric audio output signal; and controlling a volume of the electric audio output signal at a constant level depending on a charging level of the electric energy storage device to compensate for variations in volume output of the headphone device due to a varying amount of energy derived from the received electric audio signal for charging the electric energy storage device.

10. The method according to claim 9, comprising:

generating the electric audio output signal based on an electric audio input signal from a microphone such that ambient noise is at least partially compensated by the acoustic signal at an output of the electroacoustic transducer.

11. The method according to claim 9, comprising:

charging the electric energy storage device only with components of the electric audio signal having a frequency above a first frequency value or components of the electric audio signal having a frequency below a second frequency value.

12. The method according to claim 9, comprising:

powering an electric illumination device of the headphone device by electric energy from the electric energy storage device.

* * * * *